United States Patent [19]

Gillis

[11] 4,398,547

[45] Aug. 16, 1983

[54] TORUS SMOKING PIPE

[76] Inventor: Robert E. Gillis, P.O. Box 67, Aptos, Calif. 95003

[21] Appl. No.: 290,170

[22] Filed: Aug. 19, 1981

[51] Int. Cl.[3] ..... A24F 1/00; A24F 5/00; A24F 7/00

[52] U.S. Cl. ..... 131/216; 131/229; D27/3; 46/7; 46/9

[58] Field of Search ..... 131/216, 217, 229; D27/3; 46/7, 9

[56] References Cited

U.S. PATENT DOCUMENTS

| | | | |
|---|---|---|---|
| D. 39,852 | 3/1909 | Zeltmacher | D27/3 |
| 2,834,355 | 5/1958 | Grutfest | 131/229 |
| 4,094,508 | 6/1978 | Kirsch | 46/7 |
| 4,300,578 | 11/1981 | Geushbein | 46/9 |

*Primary Examiner*—V. Millin

*Attorney, Agent, or Firm*—Robert G. Slick

[57] ABSTRACT

A smoking pipe in the form of a round or oval torus is provided having a bowl for the reception of a substance to be smoked at one end and a mouth hole at the opposite end with smoke passages leading from said bowl to said mouth hole on both sides of the torus.

3 Claims, 4 Drawing Figures

TORUS SMOKING PIPE

SUMMARY OF THE INVENTION

The present invention relates to a smoking pipe of unique design. The pipe is in the form of an elongated or oval torus with a bowl at one end for the reception of the material to be smoked and a mouth hole at the opposite end. Twin passages extend from the bowl on either side of the torus to the mouth hole. There may be one or two holes in the bowl.

The main advantage of the present invention is that there is a long path for the smoke to travel and, since the smoke travels in two separate paths, the smoke is cooled due to the long path and the fact that air can circulate between the two paths.

In addition to the purely practical aspects of the pipe, with the long dual paths for cooling the smoke, the pipe is unusual and aesthetically pleasing.

Further, the pipe of the present invention is quite easily manufactured since it can be fabricated in two parts of a material such as ceramic, plastic or wood and the parts glued or otherwise fastened together.

Other objects and features of the invention will be brought out in the balance of the specification.

DESCRIPTION OF THE PREFERRED EMBODIMENT

Figure 1:
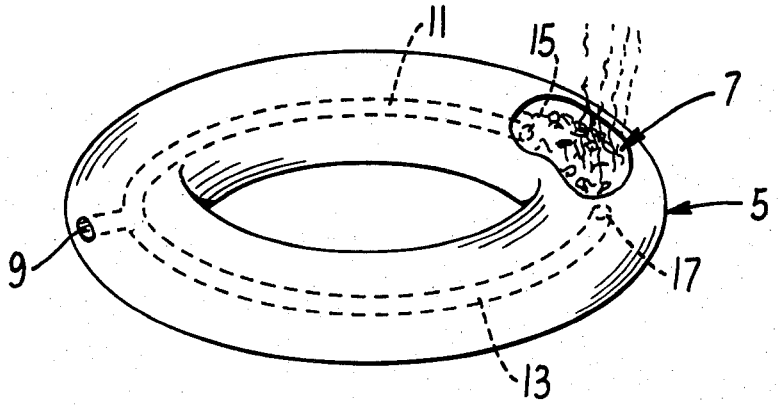
FIG. 1 is a perspective view of a smoking pipe embodying the present invention.
Figure 2:
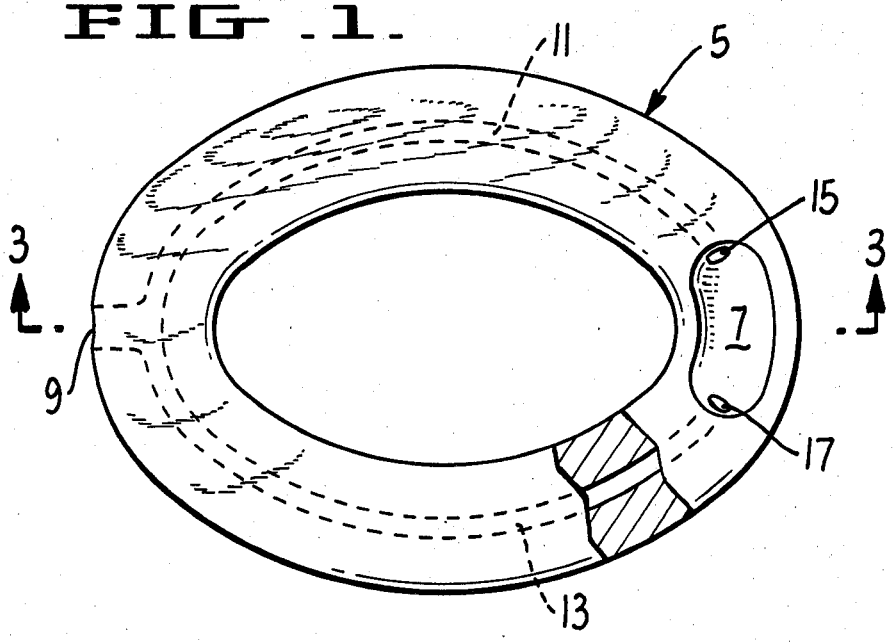
FIG. 2 is a plan view of the pipe shown in FIG. 1.
Figure 3:
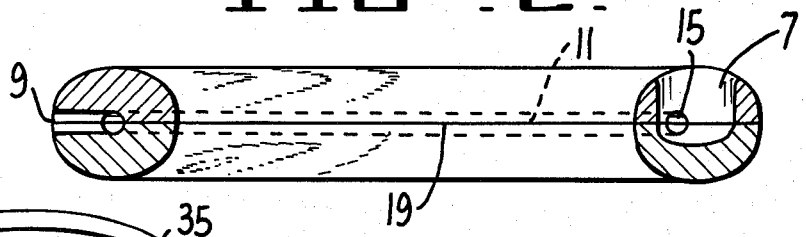
FIG. 3 is a section on the line 3—3 of FIG. 2.

Referring now to the drawings by reference characters, the pipe of the present invention is generally designated 5 and, as can best be seen in FIG. 2, is in the form of a torus. The torus can be round, as a donut, or preferably somewhat elongated so that it forms an oval when viewed in plan. At one end of the major axis of the torus is a bowl 7, for the reception of the material to be smoked such as tobacco. At the opposite end of the major axis of the torus is a mouth opening 9, and twin passages 11 and 13 going down opposite arms of the torus connect the mouth opening to the bowl 7. In the embodiment illustrated, the bowl has two outlets, namely, 15 and 17 or a single opening could be made in the bowl (not illustrated), both passages leading into this single outlet.

Figure 4:
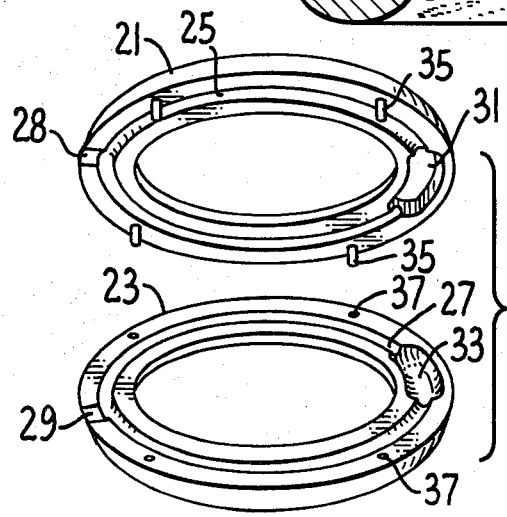
FIG. 4 is an exploded view showing how the pipe can be made in two sections which are later joined.

The article of the present invention is rather difficult to fabricate from a single piece of material but it can be done by casting, using the lost wax method. However, the article is preferably fabricated in two pieces wherein the two pieces are divided by the line 19 which bisects the plane of the smoke passage. This method of fabrication is shown in FIG. 4, wherein there is an upper half 21 and a lower half 24 each having the respective grooves 25 and 27 which fit together to form the smoke passage. Similarly, grooves 27 and 29 fit together to form the mouth opening. Of course, it is not necessary that both halves be grooved but the entire smoke passage and mouth opening could be formed in one half with the other half being plane. The upper portion of the bowl shows up as an oval slot 31 in the upper half 21 and as a slight depression 33 in the lower half 23. If desired, dowels 35 can be inserted in one half to mate with complementary holes 37 in the opposite half for strength and accurate positioning of the halves. However, the use of such dowels is not ordinarily necessary.

For aesthetic reasons, the pipe of the present invention is normally fabricated of a natural wood while it can be made of ceramic, plastic or metal.

Many variations can be made in the exact structure shown without departing from the spirit of this invention.

I claim:

1. A smoking pipe comprising a torus shaped article, said torus being disposed in a horizontal plane having a bowl at one end of the torus and a mouth opening at the opposite end of torus and two smoke passages extending from opposite sides of the bowl to opposite sides of the torus leading from said bowl to said mouth opening.

2. The structure of claim 1 wherein said torus is elongated, forming an oval in plan, with the bowl and mouth openings at opposite ends of the major axis.

3. The pipe of claim 1 formed of two halves taken along the plane of the smoke passages, said halves being joined together to form a unitary structure.

* * * * *